United States Patent [19]

Ehrich et al.

[11] 4,299,672

[45] Nov. 10, 1981

[54] BATH AND PROCESS FOR GALVANIC SEPARATION OF PALLADIUM-NICKEL ALLOYS

[75] Inventors: Hans-Jürgen Ehrich; Jörg Wähnelt, both of Berlin, Fed. Rep. of Germany

[73] Assignee: Schering Aktiengesellschaft, Berlin and Bergkamen, Fed. Rep. of Germany

[21] Appl. No.: 644,565

[22] Filed: Dec. 29, 1975

[30] Foreign Application Priority Data

Feb. 7, 1975 [DE] Fed. Rep. of Germany ..... 2506467

[51] Int. Cl.[3] ..... C25D 3/56

[52] U.S. Cl. ..... 204/43 N

[58] Field of Search ..... 204/43 N, 47

[56] References Cited

U.S. PATENT DOCUMENTS 3,933,602 1/1976 Henzi et al. ..... 204/43 N X

FOREIGN PATENT DOCUMENTS 46-25604 7/1971 Japan ..... 204/43 N
46-25606 7/1971 Japan ..... 204/43 N
46-25607 7/1971 Japan ..... 204/43 N
47-33177 8/1972 Japan ..... 204/43 N

*Primary Examiner*—G. L. Kaplan
*Attorney, Agent, or Firm*—Michael J. Striker

[57] ABSTRACT

A bath and process for the electrodeposition of palladium-nickel alloys. The bath comprises sequestering agents for the metal ions therein. Examples of such sequestering agents are glycine, aminopropionic acid, glyoxylic acid, triethylene tetramine, beta-dihydroxyphenyl-alpha-aminobutyric acid, 5-keto-valerianic acid, acetone dicarboxylic acid, polyethylene polyimine and butanone-3-carboxylic acid. The bath has good stability and produces bright deposits.

4 Claims, No Drawings

BATH AND PROCESS FOR GALVANIC SEPARATION OF PALLADIUM-NICKEL ALLOYS

This invention relates to stable ammoniacal baths for galvanic deposition of palladium-nickel alloy coatings in which the metals are present as soluble chelate complexes formed with certain sequestering agents hereafter described.

Ammoniacal, galvanic palladium baths, which contain nickel in solution are already known.

The drawback of such baths lies in their limited technical utility, since they permit neither the separation of a satisfactory, uniform alloy ratio nor a corresponding shiny coating over wide differences in current density. Moreover, the instability after long periods of working, of the solutions used sets narrow limits on technical application.

The object of the invention, therefore, is to make possible the development of a stable bath which overcomes the drawbacks depicted above, and which permits galvanic separation of a pallidium-nickel alloy with good technological and decorative properties, together with a high degree of purity and retention of the alloy ratio, from a stable electrolyte.

The object is achieved according to the invention by a bath containing palladium and nickel salts, which is characterized in that the metal salts are present as chelate compounds of the metals and sequestering agents.

By sequestering compounds we mean, in particular, those in which the metals are present as a central atom complex bonded to nitrogen- and/or oxygen-rich hydrocarbons.

The preferred hydrocarbons sequestering agents are those of the general formula:

$$R—A, \qquad \text{I}$$

in which R represents a hydroxyl or a carboxyl group, respectively in free or functionally modified form, and A a nitrogen- and/or oxygen-rich hydrocarbon radical.

In particular, A can represent a hydrocarbon radical of the general formula:

$$\begin{array}{c} R_1 \\ | \\ R_2—C— \\ | \\ R_3 \end{array} \qquad \text{II}$$

in which $R_1$ and $R_2$ represent, respectively, hydrogen or an amino group in free equivalent form, and $R_3$ a substituted or unsubstituted aliphatic or aromatic hydrocarbon radical.

Moreover, particularly suitable sequestrants are hydrocarbons of the above general formula in which A represents a hydrocarbon radical of the general formula:

$$R_4—C— \qquad \text{III}$$

in which $R_4$ represents hydrogen, an amino group in free or equivalent form or a substituted or unsubstituted aliphatic or aromatic hydrocarbon radical.

As substituents on the indicated hydrocarbon radicals, there can be mentioned, in particular, water-solubilizing groups such as, for example, $—SO_3H$, —OH or —COOH groups.

Moreover, significant sequestrants also include hydrocarbons of this general formula in which A represents an aliphatic hydrocarbon radical, preferably with 1 to 8 carbon atoms, substituted by one or more amino groups.

The sequestering compounds to be used according to the invention can be produced if, for example, a palladium salt, preferably the sulphate, the phosphate or the sulphamate, is dissolved in concentrated sulphuric acid and added to dissolve the sequestrants in molar ratios by weight of at least 1:1. This percentage can advantageously be raised to a ratio of 1:10 and higher, so that concentrations of at least 200 g/liter, and preferably 50 to 150 g/liter will result. Then, we adjust the desired pH value with an aqueous solution of ammonia.

The nickel complex is produced in analogous fashion.

As a rule however, the palladium and nickel complexes are produced not separately but in a common solution. For one part by weight of palladium we include here at least three times the quantity by weight of nickel.

As sequestrants or chelating agents the following should be mentioned in particular:

(a) Aliphatic aminocarboxylic acids with preferably up to 5 carbon atoms in the carbon chain, for example, amino acetic acid, (b) Aldehyde carboxylic acids with preferably up to 5 carbon atoms in the carbon chain, for example, glyoxylic acid, (c) Aliphatic amines with preferably up to 6 amino groups in a carbon chain containing up to 8 carbon atoms, which, can possibly be interrupted by N atoms, for example triethylene tetramine, (d) Aminocarboxylic acids substituted by hydroxy and/or sulphonic acid groups, for example betadihydroxy phenyl-alpha-amino-butyric acid, (e) Keto carboxylic acids with preferably up to 5 carbon atoms in the carbon chain, for example, 5-keto-valerianic acid, (f) Ketodicarboxylic acids with preferably up to 7 carbon atoms, in the carbon chain, for example acetone dicarboxylic acid, and (g) Polymer, water-soluble amines such as, for example N-rich polymolecules which can be both linear and branched, preferably polyethylene polyimine. These compounds are known in themselves or can be produced by processes known in themselves, for example by polymerization of polyethylene imine, polypropylene imine, or by polyamino alkylation of ammonia or of primary or secondary amines.

Nitrogen compounds have proved to be particularly suitable, when their molecular weight lies from about 300 to above 50,000 preferably from 500 to 20,000.

The compounds mentioned under (a) to (f) are known in themselves, and can be produced by known processes. These complex formers can in every case be used alone or in a mixture.

But, in order to keep that depth of luster which confers on the bath according to the invention, maximum technical possibilities of application, over a wide range of current densities, it is of particular advantage to utilize the sequestrants indicated under (a) to (f), in a mixture with small quantities of the sequestrants indicated under (g). For this purpose, concentration of these sequestrants from about 0.05 to 10 g/liter and preferably 0.5 to 2.0 g/liter will suffice.

The concentration of palladium in the bath according to the invention can range from about 0.1 g/liter to saturation, and preferably from 2 to 10 g/liter, and the concentration of nickel can be from about 0.3 g/liter to saturation, preferably from 6 to 30 g/liter.

In order to separate a uniform alloy of palladium/-nickel in proportions of 70/30, it is advisable to include in the bath a metal ratio of palladium/nickel of from 1:3 to 1:4.

In addition, the bath can contain, as further additions, substances which are already known as luster formers and for structural improvement of nickel precipitates.

These include, for example, aliphatic, unsaturated sulphonic acids, naphthalene sulphonic acids, benzene sulphonamide, benzoic acid sulphamide, butanediol, pyridine and their derivatives.

As further additions, the bath can contain pH-adjusting substances such as, for example, disodium phosphate, alkali carbonate, alkali acetate or a mixture of boric acid and ethylene glycol.

The bath is suitably operated at temperatures of 10° to 80° C., preferably from 30° to 60° C., with a current density of 0.5 to 5 amp/dm$^2$ and preferably from 1 to 2.5 amp/dm$^2$, and a pH of 7 to 9. preferably 8.

The use of the bath according to the invention takes place with continuous electrolyte rotation, filtration and movement of the material in known fashion.

Since palladium dissolves anodically with difficulty, and since, as a result a constant alloy ratio cannot be maintained, we work with insoluble anodes, such as, for example, platinum plated titanium anodes.

The palladium/nickel coatings separated from the bath according to the invention, are remarkable, surprisingly, even in thicker layers of more than the conventionally utilized layer thicknesses of 2 to 3 $\mu$m, for their high luster, their ductility and uniform coloration. With maintenance of the said conditions, alloys can be separated whose metal ratio in wide ranges of current densities, remains uniform and lies preponderently at 70:30.

The coatings, on various base materials, such as, for example, brass, German silver, nickel, white bronze and copper-tin-nickel alloys, up to 10 $\mu$m layer thickness, insure complete retention of luster. Parts with these coatings can therefore be used advantageously as custom articles, such as, for example, writing instruments, watchcases, spectacle frames and others, or in electrical engineering, for example, as conductor rails, soldering terminals, sliding contacts, and others.

The following examples will serve to illustrate the invention.

EXAMPLE 1

Composition of the bath 15 g/liter palladium sulphate
$PdSO_4.H_2O$: 67 mmol=7.1 g/liter of palladium
130 g/liter nickel sulphate
$NiSO_4.6\ H_2O$: 495 mmol=29.0 g/liter of nickel
100 g/liter glycine
$NH_2.CH_2.COOH$: 1.33 Mol
100 g/liter ammonium sulphate
$(NH_4)_2SO_4$
5 g/liter benzoic acid sulphamide
0.1 g/liter polyethylene polyimine from MG 500 to 20,000

Working conditions pH of aqueous solution (adjusted with ammonium hydroxide=8.25
Temperature=40° C.
Electrolyte rotation with cathode movement
Current density=0.5 to 2.0 amp/dm$^2$
Anode: Platinum plated titanium

Result

We obtain, over a wide range of current densities, brightly shining precipitates with 70% by weight of palladium and 30% by weight of nickel. The precipitates have an electrical conductivity of 5.8 m/ohm.mm$^2$ and a exhibit hardness of 450° $HV_{50}$

EXAMPLE 2

Composition of the bath 23 g/liter palladium sulphate
$PdSO_4.H_2O$: 100 mmol=10.6 g/liter of palladium
130 g/liter nickel sulphate
$NiSO_4.6H_2O$: 495 mmol=29.0 g/liter of nickel
89 g/liter alanine
$NH_2$-$CH_2.CH_2$-COOH: 1 mol
100 g/liter ammonium sulphate
$(NH_4)_2SO_4$
5 g/liter benzoic acid sulphamide
0.1 g/liter polyethylene polyimine from MG 500 to 20,000

Working conditions pH of aqueous solution (adjusted with ammonium hydroxide)=8.5
Temperature=60° C.
Electrolyte rotation and cathode movement
Current density=1.0 to 2.5 amp.dm$^2$
Anode: platinum plated titanium

Result

The result was uniform, highly lustrous ductile precipitates, with an average of 70% by weight of palladium and 30% by weight of nickel over a wide range of current densities.

EXAMPLE 3

Composition of the bath 15 g/liter palladium sulphate
$PdSO_4.H_2O$: 67 mmol=7.1 g/liter of palladium
130 g/liter nickel sulphate
$NiSO_4.6H_2O$: 495 mmol=29.0 g/liter of nickel
100 g/liter glyoxylic acid

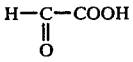

1.33 mol
100 g/liter ammonium sulphate
$(NH_4)_2SO_4$
5 g/liter benzoic acid sulphimide
0.2 g/liter polyethylene polyimine from MG 500 to 20,000

Working conditions pH of aqueous solution (adjusted with ammonium hydroxide)=8.9
Temperature=50° C.
Electrolyte rotation and cathode movement
Current density=2.0 to 3.0 amp.dm$^2$
Anode platinum plated titanium Result The separated precipitates are of corresponding luster and uniform silver-grey color. They retain a constant palladium/nickel alloy ratio=70/30.

EXAMPLE 4

Composition of the bath 15 g/liter palladium sulphate
$PdSO_4.H_2O$: 67 mmol=7.1 g/liter of palladium
130 g/liter nickel sulphate
$NiSO_4.6H_2O$: 495 mmol=29.0 g/liter of nickel
80 g/liter triethylene tetramine: 0.55 Mol
100 g/liter ammonium sulphate
3 g/liter naphthalene sulphonic acid
0.2 g/liter polyethylene polyimine from MG 500 to 20,000

Working conditions pH of aqueous solution (adjusted with ammonium hydroxide):=8.5
Temperature:=55° C.
Current density:=1.5 amp/dm$^2$
Anode: platinum plated titanium Result We obtain a silk-matt-lustrous coating with a palladium/nickel alloy ratio=65/35 and an electrical conductivity of about 6.0 m/OHM mm$^2$.

EXAMPLE 5

Composition of the bath 15 g/liter palladium sulphate
$PdSO_4.H_2O$: 67 mmol=7.1 g/ltr palladium
130 g/liter nickel sulphate
$NiSO_4.6H_2O$: 495 mmol=29.0 g/liter of nickel
85 g/liter "butanone"-3-carboxylic acid
$CH_3$-$CH_2$-CO-$CH_2$-COOH: 0.75 Mol
100 g/liter ammonium sulphate
3 g/liter benzene sulphonamide Working conditions pH of aqueous solution (adjusted with ammonium hydroxide)=8.5
Temperature=60° C.
Current density=2.5 amp/dm$^2$
Anode: platinum plated titanium Result The result is a uniform gray-matt, and in high current density ranges a silk-matt lustrous precipitate with 75% by weight of palladium and 25% by weight of nickel. The precipitate has an electrical conductivity of 6.4 m/ohm.mm$^2$.

EXAMPLE 6

Composition of the bath 15 g/liter palladium sulphate
$PdSO_4.H_2O$: 67 mmol=7.1 g/liter of palladium
130 g/liter of nickel sulphate
$NiSO_4.6H_2O$: 495 mmol=29.0 g/liter of nickel
80 g/liter acetone dicarboxylic acid $$HOOC.CH_2-\underset{\underset{O}{\|}}{C}-CH_2-COOH$$

0.55 Mol
100 g/liter ammonium sulphate
$(NH_4)_2SO_4$
3 g/liter benzoic acid sulphimide
0.1 g/liter polyethylene polyimine from MG 500 to 20,000

Working conditions pH of aqueous solution (adjusted with ammonium hydroxide)=8.5
Temperature=50° C.
Current density=2.0 amp/dm$^2$
Anode: platinum plated titanium Result We obtain a uniform grey lustrous precipitate with 70% by weight of palladium and 30% by weight of nickel, which exhibits an especially high hardness of 550 $HV_{50}$.

What is claimed is:

1. An aqueous ammoniacal bath for the galvanic deposition of a palladium-nickel alloy containing as its essential ingredients a palladium salt and a nickel salt in alloy-forming proportions, said palladium and nickel salts being present in the form of a complex with a complexing amount of at least one sequestering agent selected from the group consisting of glycine, aminopropionic acid, glyoxylic acid, triethylene tetramine, beta-dihydroxyphenyl-alpha-aminobutyric acid, 5-keto-valerianic acid, acetone dicarboxylic acid, polyethylene polyimine, and butanone-3-carboxylic acid.

2. A bath according to claim 1 containing polyethylene polyimine and at least one additional sequestering compound.

3. In a method for the galvanic deposition of palladium-nickel alloys from an ammoniacal bath containing said metals according to claim 1, the improvement which comprises providing the metal in solution as a chelate compound comprising the metal and a sequestering agent according to claim 1.

4. The method of claim 3 wherein the metal is sequestered by polyethylene polyimine and another sequestering agent selected from the group consisting of glycine, aminopropionic acid, glyoxylic acid, triethylene tetramine, beta-dihydroxyphenyl-alpha-aminobutyric acid, 5-keto-valerianic acid and butanone-3-carboxylic acid.

* * * * *